United States Patent [19]

Garcia et al.

[11] 4,222,093

[45] Sep. 9, 1980

[54] LIGHT MOUNTING FIXTURE ASSEMBLY

[75] Inventors: Octavio G. Garcia, Prairie Village, Kans.; Peter A. Lambert, Excelsior Springs, Mo.

[73] Assignee: Devine Lighting, Incorporated, Kansas City, Mo.

[21] Appl. No.: 11,796

[22] Filed: Feb. 14, 1979

[51] Int. Cl.[3] ..... F21S 1/02

[52] U.S. Cl. ..... 362/147; 362/226; 362/368; 362/404

[58] Field of Search ..... 362/147, 226, 404, 368

[56] References Cited

U.S. PATENT DOCUMENTS 3,064,851 11/1962 Guigli ..... 362/147 X

*Primary Examiner*—Stephen J. Lechert, Jr.

*Attorney, Agent, or Firm*—Schmidt, Johnson, Hovey & Williams

[57] ABSTRACT

An improved, quick connect and detach light fixture assembly is provided which allows easy pivotal attachment and release of a light fixture for ease of fixture installation or replacement. The assembly includes cooperating back and fixture-supporting plates with the latter being pivotally and detachably connected to the wall or ceiling mounted back plate. The pivotal connection between the plates is preferably accomplished by a pin secured to the back plate and a corresponding pin-receiving slot or eye provided with the shiftable fixture-supporting plate. The fixture is maintained in its operative position by means of a screw releasably interconnecting the plates.

6 Claims, 10 Drawing Figures

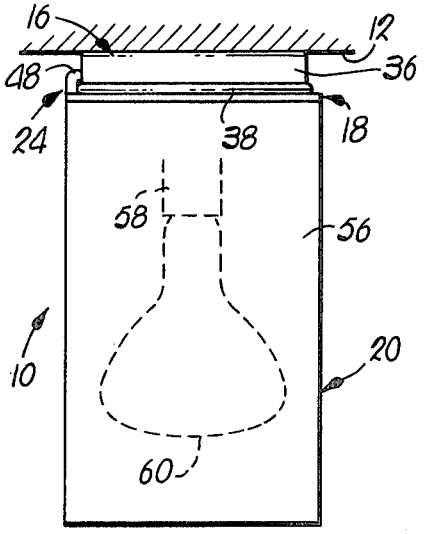
Fig.1.
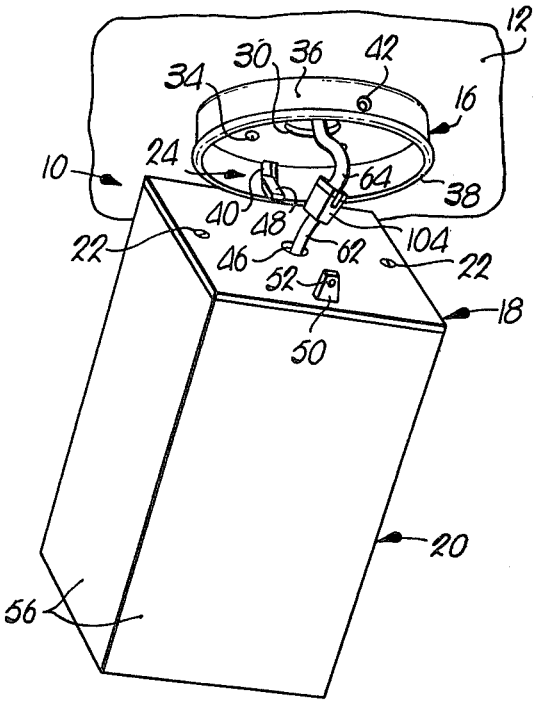
Fig.2.
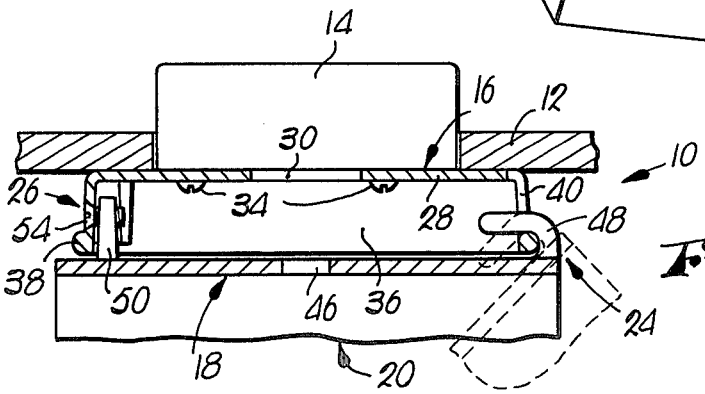
Fig.3.
Fig.4.
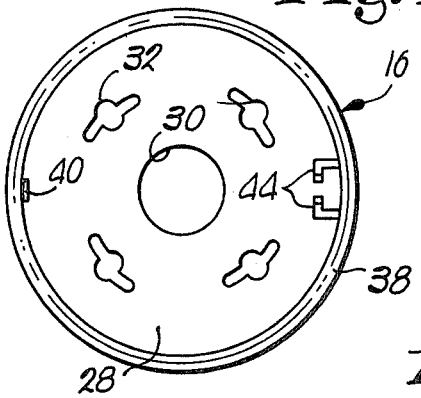
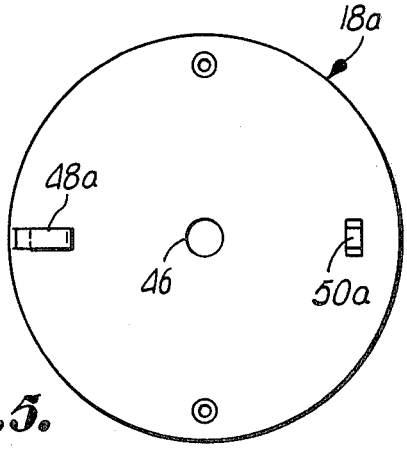
Fig.5.

LIGHT MOUNTING FIXTURE ASSEMBLY

BACKGROUND OF THE INVENTION

1. Field of the Invention

The present invention is concerned with an improved light fixture assembly which is characterized by structure allowing quick and easy installation or replacement of the fixture in the field. More particularly, it is concerned with such an assembly having a wall or ceiling-mounted back plate, along with a cooperating, fixture-supporting plate pivotally and detachably connected to the back plate so as to permit easy access to the wiring for the light fixture to facilitate installation or replacement thereof.

2. Description of the Prior Art

The conventional method of mounting a light fixture to the wall or ceiling involves first interconnecting the electrical wiring from the building and fixture, followed by substantially permanent attachment of the fixture by means of screws to appropriate threaded bores provided in the wiring junction box imbedded in the wall or ceiling. In many instances this can be a difficult task in view of the necessity of manually holding the fixture in place during initial orientation, and of aligning and finding the mounting holes for proper reception of mounting screws. While this installation procedure is not unduly burdensome for a homeowner, it will be appreciated that in public areas there may be literally hundreds or thousands of light fixtures to be installed, sometimes at extreme heights or in relatively inaccessible areas. In such cases the time consuming procedure outlined above represents a significant cost, especially considering the charges of professional electricians.

Accordingly, there is a need in the art for a specially designed fixture assembly which can be easily and quickly installed and/or replaced in the field without tedious, time consuming and expensive methods.

SUMMARY OF THE INVENTION

The present invention provides a quick connect and detach light fixture assembly which can be easily installed and/or replaced in the field with a minimum of time and effort. To this end, the assembly includes a back plate adapted to be secured to a wall, and a fixture-supporting plate pivotally and detachably mounted to the back plate, preferably by means of an opening associated with the back plate and a corresponding, complemental pivot pin secured to the fixture-supporting plate. Means for holding the fixture-supporting plate in a closed position adjacent the back plate is also provided.

BRIEF DESCRIPTION OF THE DRAWINGS

FIG. 1 is a side elevational view of one embodiment of the invention, illustrating the light fixture assembly fully installed and in operative condition;

FIG. 2 is a perspective view of the embodiment depicted in FIG. 1, but showing the light fixture pivoted away from the ceiling-mounted back plate;

FIG. 3 is a fragmentary sectional view illustrating the construction of the back plate and fixture-supporting plate, with the pivoting motion of the latter being illustrated in phantom;

FIG. 4 is a bottom view of the back plate of the assembly illustrated in FIGS. 1–3;

FIG. 5 is a plan view of a circular fixture supporting plate;

DESCRIPTION OF THE PREFERRED EMBODIMENTS

Figure 6:
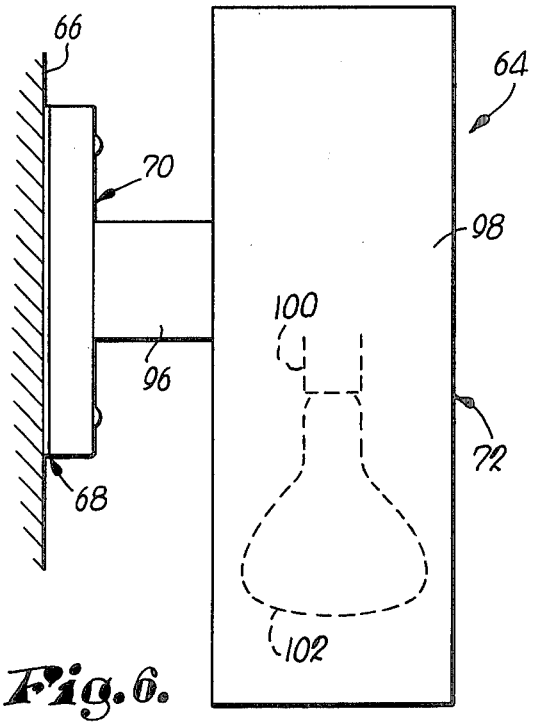
FIG. 6 is an elevational view of another embodiment of the invention, illustrating a wall-mounted version of the assembly.
Figure 9:
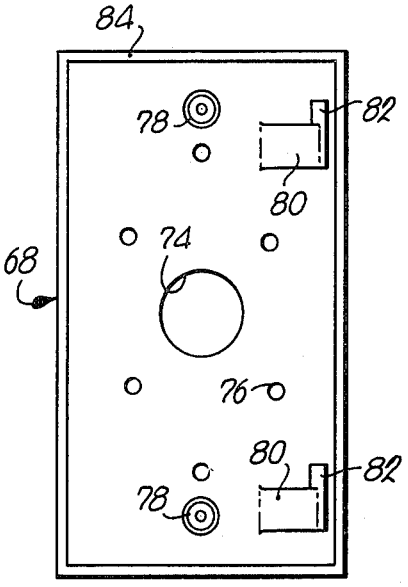
FIG. 9 is a side elevational view of the wall-mounted back plate.

Turning now to the drawings, a light fixture assembly 10 is illustrated in FIGS. 1–3. This assembly is designed to be mounted onto a ceiling 12 in underlying relationship to a conventional, junction box 14 embedded in the ceiling and having therein electrical wiring leads for the light fixture. Broadly speaking, the assembly 10 comprises an apertured back plate 16, a fixture supporting plate 18, a conventional light fixture 20 secured to the plate 18 by means of screws 22, pivotal and detachable mounting means for interconnecting the plates 16 and 18, and holding means 26 for maintaining the fixture supporting plate in its closed position illustrated in FIG. 1.

In more detail, back plate 18 is of integral metallic construction and includes an apertured, ceiling-engaging circular portion 28 having a central opening 30 therethrough for passage of wiring leads from junction box 14, and a series of spaced mounting holes 32 which receive screws 34 which fix the plate 16 to junction box 14 in the well known manner. Plate 16 further includes a peripheral, downwardly extending tubular wall portion 36 of circular configuration which terminates in a rounded marginal lip 38. In addition, an elongated, vertically extending, pin-receiving opening or slot 40 provided through the wall 36, as well as an opposed, threaded bore 42. Finally, a pair of vertically extending, L-shaped, socket-defining walls 44 are connected to the inner face of wall portion 36 and are respectively disposed on opposite sides of the bore 42.

Fixture supporting plate 18 is, in the embodiment of FIGS. 1–3, of essentially square configuration and includes a central, wire-passing opening 46 therethrough. A generally L-shaped pivot pin 48 is secured to the upper face of plate 18 and is adapted to be pivotally and detachably received within the slot 40 of back plate 16 as best seen in FIGS. 2 and 3. An upwardly extending tab 50 is also secured to the upper face of plate 18 in spaced, opposed relationship to pin 48. The tab 50 includes a transversely extending, threaded bore 52, and is moreover configured to be received within the socket presented by the cooperating walls 44 (FIG. 3). When so received, the bores 42 and 52 are in mating alignment, and holding means in the form of a screw 54 can be threaded through the respective bores.

Another fixture-supporting plate **18*a* is illustrated in FIG. 5. The only difference between the plates 18 and 18*a* resides in the fact that the latter plate is of circular configuration, whereas plate 18 is square. Thus, the plate 18*a* includes a central aperture 46*a*, spaced, somewhat smaller apertures for receiving the screws 22, and L-shaped pivot pin 48***a* and a bored, upstanding tab 50*a*. The plate illustrated in FIG. 5 can be used interchangeably with plate 18 in the event that it is desired to employ a light fixture which is circular in cross section, rather than fixture 20.

The light fixture illustrated in FIGS. 1–3 is of conventional design and includes four depending, interconnected, rectangular walls 56. The light includes the usual bulb-holding receptacle 58 adapted to receive the spotlight 60. The wiring for the light in the form of a lead 62 extends through aperture 46 (see FIG. 2), and is coupled to the corresponding lead 64 from the building.

Referring now to FIGS. 6–10, a second illustrative assembly 64 is illustrated. In this case the fixture assembly is adapted for mounting to a vertical wall 66. Here again however, the assembly broadly includes a back plate 68 for permanent mounting to the wall 66, and a conventional light fixture 72 mounted onto pivotal plate 70.

Back plate 68 is of essentially rectangular configuration and includes a central wire-clearing opening 74, a series of mounting holes 76 allowing the plate to be secured to a junction box through the use of screws (not shown), and a pair of spaced, upstanding, bored projections 78 adapted to receive screws for maintaining plate 70 in position. In addition, the plate 68 includes a pair of arcuate, pin-supporting members 80 which extend outwardly from the inner face of the plate and carry integral, upstanding, cylindrical pivot pins 82. The periphery of plate 68 is also relieved as at 84 to facilitate connection of the plates 68, 70 as will be explained.

Figure 7:
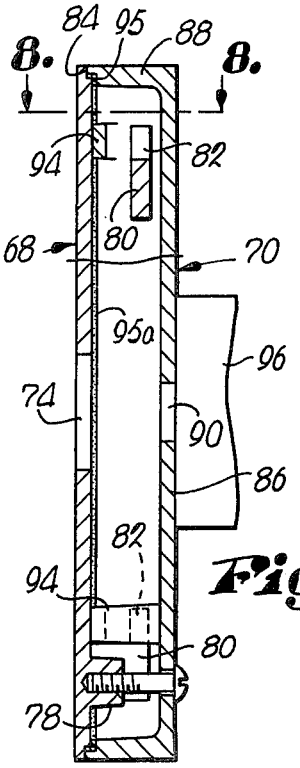
FIG. 7 is a substantially vertical sectional view depicting the interengagement between the back and fixture-supporting plates of the embodiment illustrated in FIG. 6, with a sectional offset to illustrate the pin and tubular eye connection between the plates.
Figure 8:
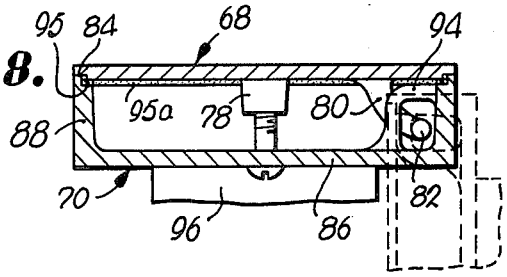
FIG. 8 is a sectional view taken along line 8—8 of FIG. 7 which further illustrates the interconnection of the plates.
Figure 10:
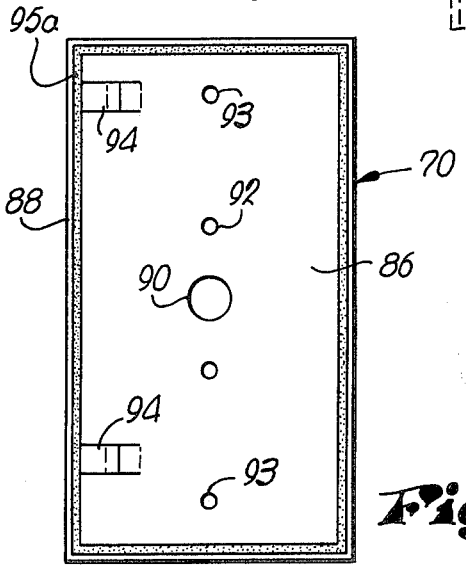
FIG. 10 is a side elevational view illustrating the pin-supporting side of the fixture-supporting plate.

Fixture-supporting plate 70 includes a rectangular outermost portion 86 and integral, circumscribing, continuous wall 88. Portion 86 includes a central, wire-clearing aperture 90 and a series of mounting holes 92 for affixing fixture 72 to plate 70. A pair of screw-receiving holes 93 are also provided through the portion 86 and are adapted to come into axial alignment with the bores of the projection 78, when the plates 68 and 70 are operatively connected. In addition, the innermost peripheral edge of the wall 88 is indented as at 95 to cooperatively engage the corresponding relieved area 84. Finally, a continuous gasket 95*a* is adapted for location in the indented area 95 to enhance the seal between the respective plates 68 and 70. A pair of spaced, substantially tubular eye projections 94 extend from the inner face of portion 86 and are sized to loosely receive the corresponding pins 82 as best seen in FIGS. 7 and 8.

Fixture 72 is of conventional construction and includes a horizontally extending mounting arm 96 which is affixed to plate 70, and a downwardly opening fixture having a circumscribing wall 98 which houses a light receptacle 100 and bulb 102.

In the use of either of the described embodiments, the following procedure is followed. First, the back plate 16 or 68 is secured to the appropriate junction box in the wall or ceiling by means of screws such as the screws 34 depicted in FIG. 3. (The wiring lead from the building is normally threaded through the aperture 30 or 74 in the back plate prior to such connection.) At this point the corresponding fixture-supporting plate (already having the fixture secured thereto) is pivotally and detachably connected to the back plate. In the case of assembly 10, this involves simply pushing the L-shaped pivot pin 48 into the corresponding slot 40 as best illustrated in FIG. 2. On the other hand, with assembly 64 it is only necessary to manipulate the plate 70 so that the eye projections 94 fit over the complemental pivot pins 82.

With the fixture and fixture-supporting plate so oriented and temporarily held in place, interconnection of the wiring leads between the junction box and fixture can be readily and easily accomplished. Preferably, use is made of quick connects such as the conventional clip structure 104 illustrated in FIG. 2. In any event, after the wiring operation is completed, it is only necessary to pivot the fixture-supporting plate and attached fixture into the closed position and screw the same into place using either screw 54 (embodiment of FIGS. 1–3) or a pair of screws 106 which extend through the bores 93 and into the projections 78 (embodiment of FIGS. 6–10).

It will also be seen that if it is desired to repair or replace a fixture, the above described procedure can be reversed in order to greatly facilitate such work.

Having thus described the invention, what is claimed as new and desired to be secured by Letters Patent is:

1. A light fixture assembly, comprising:

an apertured back plate adapted to be secured to a support surface such as a wall or ceiling with electrical wiring for a fixture passing through said aperture;

a fixture-supporting plate;

means for connecting said light fixture to said fixture-supporting plate;

means for detachably and pivotally mounting said fixture-supporting plate to said back plate for selective movement of the fixture-supporting plate and fixture between a closed, operative position wherein the back plate and fixture-supporting plate are adjacent one another, to an open position wherein said fixture-supporting plate is pivoted from the back plate allowing access to the electrical wiring for the light fixture, and for complete detachment of the fixture-supporting plate and the back plate as desired; and means for releasably holding said fixture-supporting plate in said closed position.

2. The fixture assembly as set forth in claim 1 wherein said mounting means comprises:

a pivot pin secured to the one of said plates;

structure on the other of said plates defining an opening for pivotally and detachably receiving said pin.

3. The fixture assembly as set forth in claim 2 wherein said back plate includes a portion adapted for engagement with said support surface, and a wall extending from said portion, said opening being in the form of a slot located substantially in said wall, said pin being secured to said fixture-supporting plate and being of generally L-shaped configuration.

4. The fixture assembly as set forth in claim 2 wherein said pin is spaced from and supported by said back plate, said opening-defining structure comprising tubular eye secured to said fixture-supporting plate and receiving said pin.

5. The fixture assembly as set forth in claim 1 wherein said holding means comprises structure defining a pair of threaded bores respectively through said fixture-supporting plate and extending into said back plate, said bore being oriented for axial alignment when said fixture-supporting plate is in said closed position, and a screw threaded into said bores when the latter are mated.

6. The fixture assembly as set forth in claim 1 wherein said holding means comprises:

a tab on one of said plates having a threaded bore therethrough;

a socket on the other of said plates for receiving said tab when said fixture-supporting plate is in said closed position, said socket having a threaded bore therethrough which mates with the tab bore when said tab is received in said socket; and a screw threaded into said bores when the latter are mated.

* * * * *